US005203180A

United States Patent [19]

Weisbrich

[11] Patent Number: 5,203,180

[45] Date of Patent: Apr. 20, 1993

[54] REFRIGERATOR COUNTER

[75] Inventor: Fred R. Weisbrich, Frankfurt am Main, Fed. Rep. of Germany

[73] Assignee: Nax GmbH & Co. Ladenbau OHG, Frankfurt am Main, Fed. Rep. of Germany

[21] Appl. No.: 811,933

[22] Filed: Dec. 23, 1991

[30] Foreign Application Priority Data

Aug. 24, 1991 [DE] Fed. Rep. of Germany ..... 4128148

[51] Int. Cl.[5] ..... A47F 3/04

[52] U.S. Cl. ..... 62/247; 261/DIG. 14; 261/DIG. 76

[58] Field of Search ..... 62/247, 306, 309, 314; 261/DIG. 14, DIG. 76

[56] References Cited

U.S. PATENT DOCUMENTS

| | | | |
|---|---|---|---|
| 1,880,359 | 10/1932 | Rutishauser | 62/247 |
| 2,502,893 | 4/1950 | Schmidt et al. | 62/247 X |
| 3,854,468 | 12/1974 | Noyaki | 126/113 |
| 4,630,451 | 12/1986 | Kishimoto | 62/247 |
| 4,662,187 | 5/1987 | Lamb et al. | 62/274 |
| 4,738,806 | 4/1988 | Noma et al. | 62/247 X |
| 4,913,856 | 4/1990 | Morton | 261/DIG. 76 |

FOREIGN PATENT DOCUMENTS

| | | |
|---|---|---|
| 3508651 | 10/1985 | Fed. Rep. of Germany . |
| 4001491 | 7/1991 | Fed. Rep. of Germany . |
| 2017285 | 10/1979 | United Kingdom . |

*Primary Examiner*—William E. Tapoicai
*Attorney, Agent, or Firm*—Wenderoth, Lind & Ponack

[57] ABSTRACT

A refrigerator counter includes a goods receiving chamber and a counter bed. Following cooling by a cooling source and following moistening by hot steam of an air moistening system, a circulating air current is conveyed through the goods receiving chamber and from it at least in part back to the cooling source and to a steam feed point. Following cooling, at least one portion of the resultant cold air is branched off from the circulating air current and is swirled in a mixed air chamber with hot steam guided into the mixed air chamber. Resulting moistened mixed air is conveyed by at least one steam outlet nozzle into the goods receiving chamber.

14 Claims, 2 Drawing Sheets

REFRIGERATOR COUNTER

BACKGROUND OF THE INVENTION

The invention relates to a refrigerator counter, in particular for fresh goods such as meat, including a goods receiving chamber for the goods to be kept cool and a counter bed, wherein following cooling by means of a cooling source and following moistening by means of hot steam of an air moistening system, a circulating air current is conveyed through the goods receiving chamber and from it at least in part back to the cooling source and to a steam feed point.

Such refrigerator counters are known, for example from DE-OS 27 25 472, DE-OS 32 30 792, DE-OS 36 05 967 and DE-OS 40 01 491, and are used for sales purposes in stores, large markets and similar sales locations. They serve to store and display food, in particular unpacked food such as meat, sausages, cheese and delicacies. Apart from being cooled, the goods are prevented from drying out due to the controlled moistening of the circulating air current. Thereby, the freshness and appearance of the goods can be guaranteed for a prolonged period of time. An internal steam generator produces hot steam by heating water above a requisite sterilization temperature, for example above 100° C., so that the hot steam can arrive sterilized into the cold circulating air stream owing to intrinsic pressure. In so doing, under specific conditions the distribution of the hot steam by means of individual distributor pipes and in the goods receiving chamber itself presents some difficulties. In addition, undesired fog and condensation can form in the counter and thus also on the goods. Furthermore, under some conditions an undesired high proportion of hot steam flows up out of the goods receiving chamber and is thus lost.

SUMMARY OF THE INVENTION

The object of the invention is to provide a refrigerator counter of the aforementioned type, in particular capable of avoiding the aforementioned drawbacks of the prior art, and whose simple design and energy saving mode of operation permits the circulating air current to be moistened effectively.

This object is achieved by providing that, following cooling, at least one portion of the cold circulating air stream is branched from the circulating air current and is swirled in a mixed air chamber with hot steam guided into the mixed air chamber, and that the resulting moistened mixed air is conveyed by means of at least one steam outlet nozzle into the goods receiving chamber.

In this manner, there thus is achieved both an improved distribution of saturated cold air produced at individual distributor pipes to individual counter sections and an improved distribution of saturated cold air in the circulating air and thus in the goods receiving chamber. Thus, at low temperatures 100% saturated air with physically pure sterilized steam is fed to the circulating air current, without resulting in the disadvantageous formation of fog and condensation in the counter or on the goods. Furthermore, a significant amount of energy can be saved as compared to past counters with steam moistening, because the heat, which to date resulted from the direct introduction of hot steam at the distributor pipe, is withdrawn from the cold air circulation by means of the mixed air chamber and losses due to thermal ascendancy are virtually avoided.

If the cooling source designed, for example, as an evaporator is disposed in the counter bed, the invention can be realized, for example, in a simple manner in that a cold air line branches off from the counter bed in the direction of the circulating air behind the cooling source to the mixed air chamber, in that steam opens into the mixed air chamber directly or indirectly from the internal steam generator, and that from the mixed air chamber at least one mixed air line branches off to at least one steam outlet nozzle. Thus, the internal steam generator is not connected, as provided to date, directly to the steam distributor pipe from which the hot steam flows into the cold circulating air current. Rather, the hot steam line opens first into a separate mixed air chamber which is supplied with cold air from a cold air line branching off from the circulating air current. Not until after the hot steam mixed with the cold air in the separate mixed air chamber is the thus saturated cold air returned into the circulating air current.

In accordance with a special design of the invention, the cold air can be conveyed into the mixed air chamber by arranging in the mixed air chamber a fan which sucks cold air from the circulating air current into the mixed air chamber and there mixes such cold air with the separately supplied hot steam. The fan also generates the requisite pressure in order to convey the resulting mixed air by means of the distributor lines to the steam outlet nozzles and thus into the goods receiving chamber. In so doing, it is especially advantageous if the hot steam line opens first into a hot steam chamber that is adjacent the mixed air chamber and from which, after the steam passes through a cooling segment or section, the hot steam flows into the mixed air chamber. The mixed air chamber and the hot steam chamber can be housed expediently in a common housing to which the various aforementioned lines can be attached.

Furthermore, it is proposed with the invention that the steam outlet nozzle(s) open(s) into that portion of the circulating air current that is returned, following cooling, directly into the goods receiving chamber. An especially effective moistening of the circulating air current in the goods receiving chamber is achieved if the steam outlet nozzle(s) open(s) into an area of the goods receiving chamber in which that portion of circulating air current that is returned, following cooling, directly into the goods receiving chamber also flows into the goods receiving chamber. The region of the circulating air intake and thus also the mixed air intake into the goods receiving chamber is located preferably at a position above the goods receiving floor of the goods receiving chamber, so that the cold and moistened circulating air can be distributed in an advantageous manner so as to drop over the goods arranged on the goods receiving floor. In order to obtain an especially good distribution of the generated, moistened mixed air in all desired counter regions, the steam outlet nozzles are provided in an advantageous manner in a distribution pipe extending over the length of the goods receiving chamber or at least a significant sub-length thereof.

To draw off condensation produced during the generation of the cold mixed air, the mixed air chamber can be equipped expediently with a condensation discharge. It is, of course, obvious that the hot steam is supplied only in such amounts that undesired condensation is avoided as much as possible along the circulating path. The collected condensation can be recycled to the internal steam generator.

BRIEF DESCRIPTION OF THE DRAWINGS

Other goals, features, advantages and possible applications of the present invention follow from the following description of an embodiment thereof, with the aid of the accompanying drawings, wherein all described and/or illustrated features form by themselves or in any logical combination the subject matter of the present invention, even independently of their summary in the claims, and wherein:

DETAILED DESCRIPTION OF THE INVENTION

Figure 1:
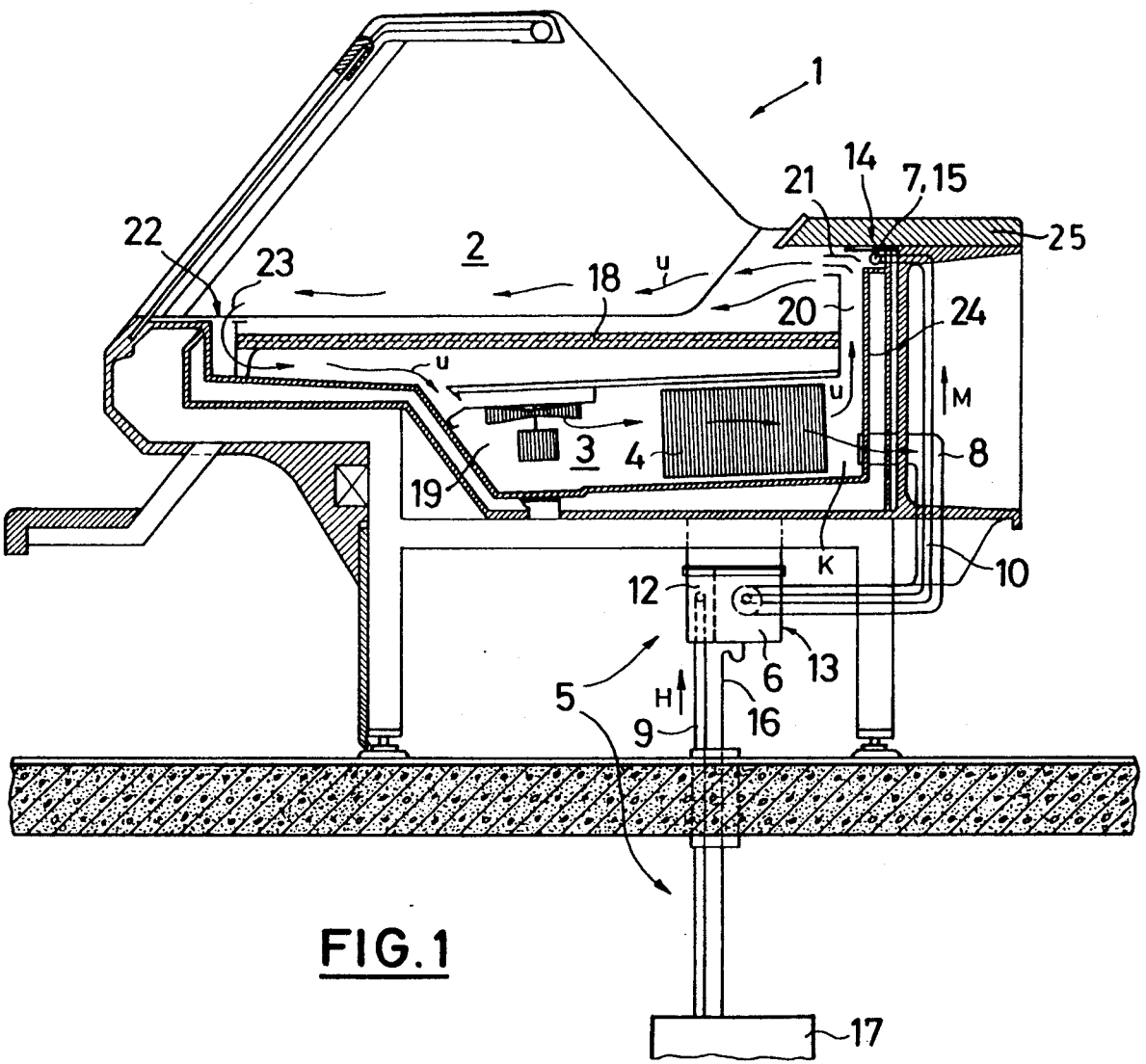
FIG. 1 is a diagrammatic cross sectional view of a refrigerator counter embodying the invention.

A refrigerator counter 1 shown in FIG. 1 includes a counter top having an interior that is subdivided, by a goods receiving floor 18, into an upper goods receiving chamber 2 and a counter bed 3 arranged therebeneath. The goods receiving chamber 2 serves to hold goods to be offered for sale, for example fresh goods such as meat. The counter bed 3 has therein a fan 19 and, downstream in the flow direction thereof, a cooling device or source 4 designed as an evaporator. With the aid of the fan 19 and the cooling source 4, there is produced a cooled circulating air current U (indicated by the directional arrows) flowing toward the seller side in the counter bed 3 and flowing toward the buyer side in the goods receiving chamber 2. The circulating air current U flows from the fan 19 through the cooling source 4 to an additional air chamber 20, which extends vertically along a seller side wall 24 of the counter top, through outlet openings 21 into the goods receiving chamber 2, then is withdrawn from chamber 2 on the buyer side thereof through an exit slot 22, and is recycled through a suction channel 23 into the counter bed 3.

The additional air channel 20 with the outlet openings or slots 21 and the exit slot 22 can extend or be distributed, at least at portions thereof facing the goods receiving chamber 2, over the entire length or sublengths of the counter body (i.e. in directions perpendicular to the plane of the drawing), in order to obtain a uniform distribution of the air circulating current U over the length of the refrigerator counter 1 or over lengths of subsections thereof.

Figure 2:
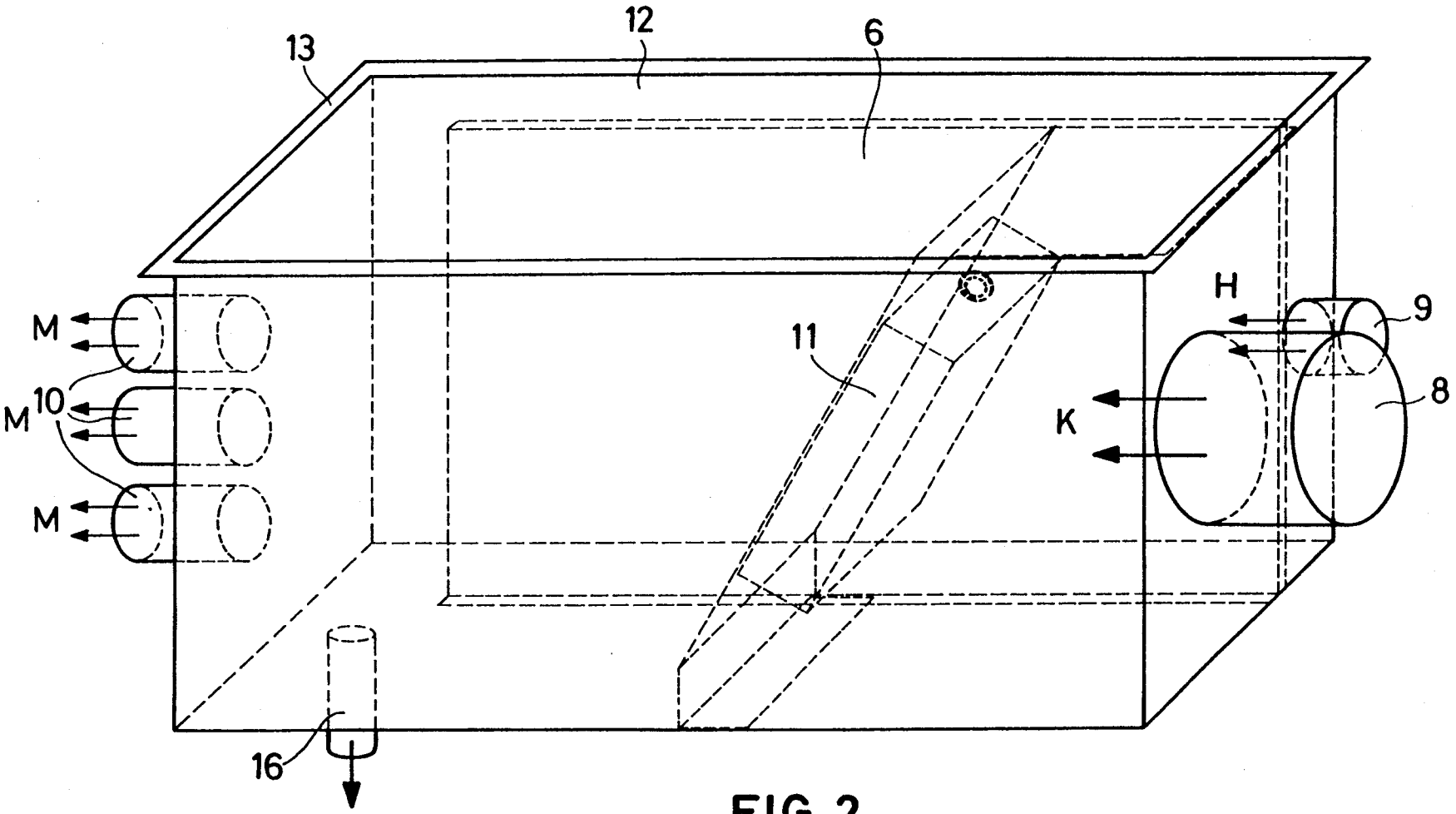
FIG. 2 is a perspective view of a moistening device having a mixed air chamber as provided within the scope of the invention.

In side wall 24 of the counter top is a cold air line 8, through which cold air is sucked by means of a fan 11 (see FIG. 2) into a mixed air chamber 6 provided in a separate housing 13. Line 8 branches from the counter bed 3 in a region thereof between the cooling source 4 and the exit openings 21. Housing 13, which also accommodates a hot steam chamber 12 arranged next to the mixed air chamber 6, is mounted on the bottom side of the counter top. A hot steam line 9 of a moistening device 5, which starts from an internal steam generator 17, opens into the hot steam chamber 12. In the illustrated case the internal steam generator 17 is arranged for spacial reasons in a floor below the sales room in which the refrigerator counter 1 stands. Still other sections of the refrigerator counter 1 or also other refrigerator counters can also be supplied by the same moistening device 5. The hot steam generated by the internal steam generator 17 flows sterilized owing to the intrinsic pressure through the hot steam line 9, first into the hot steam chamber 12 (see FIG. 2). Such hot steam passes through the length of chamber 12, i.e. a cooling segment or section, and then through an opening into the mixed air chamber 6. With the aid of the fan 11 the cold air K and the hot steam H are swirled in the mixed air chamber 6. Owing to the pressure of fan 11, the resulting generated moistened mixed air M is guided into one or more mixed air lines 10 and then to one or more steam outlet nozzles 7, from which mixed air M is distributed and blown out into chamber 2. The mixing chamber 6 is equipped with a condensation discharge 16.

As is evident from FIG. 1, the steam outlet nozzles 7 are located in a region 14 of the goods receiving chamber 2 directly on the seller side of the exit openings 21 for the cooled circulating air U returned from the cooling source 4 directly by means of the additional air channel 20 into the goods receiving chamber 2. Thus, the mixed air M mixes at region 14 into the circulating air current U, and a uniform distribution of the saturated cold mixed air M is produced. The steam outlet nozzles 7 are distributed over the length of a distribution pipe 15, which extends over the entire length or at least a significant sub-length of the goods receiving chamber 2 (in a direction perpendicular to the plane of the drawing). In this manner, uniform distribution of the saturated cold mixed air M over the length of the refrigerator counter 1 or a desired subsection of the refrigerator counter 1 is achieved. In so doing, the steam outlet nozzles 7 are located directly under a work board 25 for sales personnel, so that optimal flow conditions of the moistened circulating air U prevails in the goods receiving chamber 2.

I claim:

1. A refrigerator counter comprising:

a goods receiving chamber;

a counter bed;

means for circulating an air current through said goods receiving chamber and therefrom into said counter bed;

means for cooling said air current prior to introduction thereof into said goods receiving chamber, thus forming a cooled air current;

means for branching a portion of said cooled air current and for introducing said portion into a mixed air chamber;

means for introducing hot sterilized physically pure steam into said mixed air chamber and therein swirling with said portion of said cooled air current, thereby forming moistened mixed air;

at least one steam outlet nozzle; and means for supplying said moistened mixed air from said mixed air chamber through said at least one steam outlet nozzle into said goods receiving chamber.

2. A refrigerator counter as claimed in claim 1, wherein said circulating means comprises a fan located in said counter bed and recirculating said air current from said counter bed through said goods receiving chamber and at least partially back to said counter bed.

3. A refrigerator counter as claimed in claim 2, wherein said cooling means is positioned downstream of said fan, relative to the direction of flow of said air current.

4. A refrigerator counter as claimed in claim 3, wherein said branching means comprises a cold air line leading from said counter bed at a position downstream of said cooling means to said mixed air chamber.

5. A refrigerator counter as claimed in claim 1, wherein said steam introducing means comprises a hot steam line extending from a steam generator and communicating with said mixed air chamber.

6. A refrigerator counter as claimed in claim 5, wherein said supplying means comprises at least one mixed air line extending from said mixed air chamber and communicating with said at least one steam outlet nozzle.

7. A refrigerator counter as claimed in claim 5, further comprising a fan located in said mixed air chamber and operable to draw said portion of said cooled air current into said mixed air chamber and to cause swirling therein of said portion with said steam.

8. A refrigerator counter as claimed in claim 5, further comprising a hot steam chamber positioned adjacent said mixed air chamber, said hot steam line opening into said hot steam chamber at a first end thereof, and said hot steam chamber being connected at a second end thereof to said mixed air chamber, such that said steam enters said mixed air chamber at said second end of said hot steam chamber.

9. A refrigerator counter as claimed in claim 8, wherein said mixed air chamber and said hot air chamber are housed within a common housing.

10. A refrigerator counter as claimed in claim 1, wherein said at least one steam outlet nozzle opens into a part of said cooled air current being introduced into said goods receiving chamber.

11. A refrigerator counter as claimed in claim 10, wherein said at least one steam outlet nozzle is located at a position at which said part of said cooled air current enters said goods receiving chamber.

12. A refrigerator counter as claimed in claim 1, comprising a plurality of said steam outlet nozzles.

13. A refrigerator counter as claimed in claim 12, wherein said plurality of steam outlet nozzles are located along a distribution pipe extending along at least a substantial part of a length of said counter.

14. A refrigerator counter as claimed in claim 1, further comprising a condensation discharge extending from said mixed air chamber.

* * * * *